US006110883A

United States Patent [19]

Petri et al.

[11] Patent Number: 6,110,883

[45] Date of Patent: Aug. 29, 2000

[54] AQUEOUS ALKALINE PEROXYGEN BLEACH-CONTAINING COMPOSITIONS

[75] Inventors: Marco Petri, Angera Varese; Marina Trani, Rome, both of Italy

[73] Assignee: The Procter & Gamble Company, Cincinnati, Ohio

[21] Appl. No.: 09/308,064

[22] PCT Filed: Nov. 6, 1997

[86] PCT No.: PCT/US97/20513

§ 371 Date: May 13, 1999

§ 102(e) Date: May 13, 1999

[87] PCT Pub. No.: WO98/21299

PCT Pub. Date: May 22, 1998

[30] Foreign Application Priority Data

Nov. 13, 1996 [EP] European Pat. Off. ..... 96870145

[51] Int. Cl.[7] ..... C11D 1/90; C11D 1/92; C11D 3/30; C11D 3/39; C11D 3/395

[52] U.S. Cl. ..... 510/372; 510/303; 510/309; 510/321; 510/342; 510/350; 510/378; 510/433; 510/499; 510/505

[58] Field of Search ..... 510/372, 378, 510/303, 309, 321, 342, 350, 433, 499, 505; 252/186.42, 186.43

[56] References Cited

U.S. PATENT DOCUMENTS

| | | | |
|---|---|---|---|
| 4,900,468 | 2/1990 | Mitchell et al. | 8/648 |
| 5,500,154 | 3/1996 | Bacon et al. | 510/102 |
| 5,512,699 | 4/1996 | Connor et al. | 564/153 |
| 5,674,828 | 10/1997 | Knowlton et al. | 510/372 |
| 5,929,012 | 9/1999 | Del Duca et al. | 510/303 |

*Primary Examiner*—Gregory R. Delcotto
*Attorney, Agent, or Firm*—Richard S. Echler, Sr.; Kim William Zerby; Jacobus C. Rasser

[57] ABSTRACT

The present invention relates to stable liquid aqueous cleaning compositions having a pH above 8, and comprising a zwitterionic surfactant, a peroxygen bleach, a radical scavenger, a chelating agent, a pH buffer, an antimicrobial essential oil, and a solvent.

20 Claims, No Drawings

AQUEOUS ALKALINE PEROXYGEN BLEACH-CONTAINING COMPOSITIONS

TECHNICAL FIELD

The present invention relates to aqueous alkaline peroxygen bleach-containing compositions, and more particularly, to stabilised and buffered compositions.

BACKGROUND OF THE INVENTION

Aqueous household detergent compositions have, for many years, employed bleaches for the purpose of bleaching and/or disinfecting hard-surfaces and/or fabrics. Hypochlorite bleaches have been used most extensively for this purpose because they are highly effective and inexpensive. A drawback associated with hypochlorite bleaches is that they are perceived by the consumer as being not fully satisfactory regarding their safety profile.

Aqueous compositions comprising a peroxygen bleach have generally been less utilised in the household market, although they deliver effective bleaching performance and/or disinfecting performance, and they are perceived by the consumer as being less harsh than compositions based on hypochlorite. For example, hydrogen peroxide is generally perceived to be environmentally acceptable as its decomposition products are oxygen and water. It is believed that this lack of use in the household is partially attributable to the instability of aqueous peroxygen bleach-containing compositions. This instability is particularly noticeable in alkaline medium where it is mediated principally by contamination of metal ion occurring in the composition itself and/or in the wash solution obtained after having diluted the composition with water.

Furthermore, although such aqueous peroxygen bleach-containing compositions provide effective bleaching and/or disinfecting, they do not effectively remove greasy stains. Thus, there is still some room to further improve the greasy stain removal performance of liquid aqueous peroxygen bleach based compositions.

It is thus an object of the present invention to provide liquid aqueous peroxygen bleach-containing compositions which are effective in removing greasy stains, which are chemically more stable, and which provide effective disinfecting performance.

It has now been found that these objects can be achieved by formulating liquid aqueous alkaline compositions having a pH above 8, comprising a peroxygen bleach, a radical scavenger, a chelating agent and a pH buffer.

Indeed, it has surprisingly been found that the combined use of a chelating agent preferably a phosphonate/amino phosphonate chelating agent, a radical scavenger, preferably di-tert-butyl hydroxy toluene (BHT) and/or butyl hydroxyanisol (BHA), and a pH buffer, preferably a borate pH buffer, in an alkaline aqueous peroxygen bleach-containing composition, maintains both the pH and the peroxygen bleach stability upon prolonged storage periods. Furthermore, it has now been found that by formulating such an aqueous peroxygen bleach-containing composition at a pH above 8, comprising a chelating agent, a radical scavenger and a pH buffer, improved greasy stain removal performance is delivered while providing effective disinfecting performance.

The compositions according to the present invention are suitable for use on all types of surfaces, including inanimate surfaces like hard-surfaces, fabrics, cloths, carpets and the like, as well as on animate surfaces like human skin, mouths and the like. Preferred applications of the compositions of the present invention are hard-surfaces applications and/or laundry applications, e.g., as a laundry detergent, a laundry additive, or even as a laundry pretreater. More particularly, an advantage of the compositions according to the present invention is that they are suitable to be used on delicate surfaces. Indeed, when using the compositions according to the present invention in a laundry application fabric damage and/or color damage is reduced as compared to the same compositions without said chelating agent and/or radical scavenger.

The aqueous compositions of the present invention may comprise an antimicrobial compound preferably an antimicrobial essential oil and/or active thereof, which further contributes to the disinfecting performance of the compositions. An advantage of such compositions is that they deliver effective disinfection on a broad range of bacterial strains including Gram positive and Gram negative bacterial strains but also more resistant microorganisms like fungi, this even at high dilution levels, e.g., up to dilution levels of from 1:100 (composition:water).

The aqueous compositions herein may also comprise at least one surfactant and/or at least one solvent which further contribute to the overall stain removal performance of said compositions.

BACKGROUND ART

EP-B-209 228 discloses stabilised peroxide compositions having a pH of from 1 to 8, and comprising a peroxygen component (e.g. hydrogen peroxide), a metal chelating agent (e.g., an amino phosphonate) and a radical scavenger (e.g., di-tert-butyl hydroxy toluene).

SUMMARY OF THE INVENTION

The present invention encompasses a stable liquid aqueous cleaning composition having a pH above 8, and comprising a peroxygen bleach, a radical scavenger, a chelating agent and a pH buffer.

In a preferred embodiment of the present invention, the composition further comprises an antimicrobial compound like an antimicrobial essential oil and/or an active thereof.

In another preferred embodiment of the present invention, the composition further comprises a solvent and/or a surfactant.

DETAILED DESCRIPTION OF THE INVENTION

As a first essential ingredient, the compositions according to the present invention comprise a peroxygen bleach, or a mixture thereof. Preferred peroxygen bleaches are hydrogen peroxide, or a water-soluble source thereof, or a mixture thereof. Hydrogen peroxide is most preferred to be used in the compositions according to the present invention.

It is believed that the presence of a peroxygen bleach especially hydrogen peroxide, in the compositions of the present invention contribute to the disinfection properties and/or bleaching properties of said compositions.

As used herein a hydrogen peroxide source refers to any compound which produces perhydroxyl ions when said compound is in contact with water. Suitable water-soluble sources of hydrogen peroxide for use herein include percarbonates, persilicate, persulphate such as monopersulfate, perborates, peroxyacids such as diperoxydodecandioic acid (DPDA), magnesium perphthalic acid, dialkylperoxides, diacylperoxides, preformed percarboxylic acids, organic and inorganic peroxides and/or hydroperoxides or mixtures thereof.

Typically, the compositions herein comprise from 0.01% to 15% by weight of the total composition of said peroxygen bleach or mixtures thereof, preferably from 0.1% to 10%, more preferably from 0.5% to 8% and most preferably from 0.3% to 5%.

As a second essential ingredient, the compositions according to the present invention comprise a chelating agent, or a mixture thereof. Suitable chelating agents to be used herein are selected from the group consisting of phosphonate chelating agents, aminophosphonate chelating agents, substituted heteroaromatic chelating agents, and mixtures thereof.

Suitable phosphonate chelating agents to be used herein include etidronic acid (1-hydroxyethylene-diphosphonic acid (HEDP)), and/or alkali metal ethane 1-hydroxydiphosphonates.

Suitable amino phosphonate chelating agents to be used herein include amino alkylene poly (alkylene phosphonates), nitrilotris(methylene)triphosphonates, ethylene diamine tetra methylene phosphonates, and/or diethylene triamine penta methylene phosphonates.

These phosphonate/amino phosphonate chelating agents may be present either in their acid form or as salts of different cations on some or all of their acid functionalities. Such phosphonate/amino phosphonate chelating agents are commercially available from Monsanto under the trade name DEQUEST®.

Substituted heteroaromatic chelating agents to be used herein include hydroxypiridine-N-oxide or a derivative thereof.

Suitable hydroxy pyridine N-oxides and derivatives thereof to be used according to the present invention are according to the following formula:

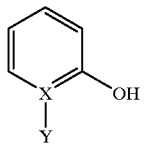

wherein X is nitrogen, Y is one of the following groups oxygen, —CHO, —OH, —(CH2)n—COOH, wherein n is an integer of from 0 to 20, preferably of from 0 to 10 and more preferably is 0, and wherein Y is preferably oxygen. Accordingly particularly preferred hydroxy pyridine N-oxides and derivatives thereof to be used herein is 2-hydroxy pyridine N-oxide.

Hydroxy pyridine N-oxides and derivatives thereof may be commercially available from Sigma.

These chelating agents, especially phosphonate chelating agents like 1-hydroxyethylene diphosphonic acid, are particularly preferred in the compositions according to the present invention as they have been found to contribute to the chemical stability of the compositions of the present invention comprising the peroxygen bleach (e.g., hydrogen peroxide) but also to the disinfecting properties of said compositions.

Typically, the chelating agent, or a mixture thereof, is present in the compositions of the present invention at a level of from 0.001% to 10% by weight of the total composition, preferably from 0.005% to 5% and more preferably from 0.01% to 2%.

As a third essential ingredient, the compositions according to the present invention comprise a radical scavenger, or a mixture thereof. Suitable radical scavengers for use herein include the well-known substituted mono and di hydroxy benzenes and derivatives thereof, alkyl- and aryl carboxylates and mixtures thereof. Preferred radical scavengers for use herein include di-tert-butyl hydroxy toluene (BHT), p-hydroxy-toluene, hydroquinone (HQ), di-tert-butyl hydroquinone (DTBHQ), mono-tert-butyl hydroquinone (MTBHQ), tert-butyl-hydroxy anisole (BHA), p-hydroxyanisole, benzoic acid, 2,5-dihydroxy benzoic acid, 2,5-dihydroxyterephtalic acid, toluic acid, catechol, t-butyl catechol, 4-allyl-catechol, 4-acetyl catechol, 2-methoxyphenol, 2-ethoxy-phenol, 2-methoxy-4-(2-propenyl)phenol, 3,4-dihydroxy benzaldehyde, 2,3-dihydroxy benzaldehyde, benzylamine, 1,1,3-tris(2-methyl-4-hydroxy-5-t-butylphenyl) butane, tert-butyl-hydroxy-aniline, p-hydroxy aniline as well as n-propyl-gallate. Highly preferred for use herein are di-tert-butyl hydroxy toluene, which is for example commercially available from SHELL under the trade name IONOL CP® and/or tert-butyl-hydroxy anysole. These radical scavengers further contribute to the stability of the peroxygen bleach-containing compositions herein.

Typically, the compositions according to the present invention comprise from 0.0005% to 5% by weight of the total composition of said radical scavenger, or mixtures thereof, preferably from 0.005% to 1.5% and more preferably from 0.01%to 1%.

As a fourth essential ingredient, the compositions according to the present invention comprise a pH buffer, or a mixture thereof.

By "pH buffer" it is meant herein a system composed of a compound or a combination of compounds, whose pH changes only slightly when a strong acid or base is added. Thus, the presence of a pH buffer in the compositions of the present invention allows to maintain the pH of said compositions above 8 for a longer period of time during the self-life of the compositions, as compared to the same compositions without said pH buffer.

Suitable pH buffers for use herein include borate pH buffer, phosphonate, silicate and mixtures thereof.

Suitable borate pH buffers for use herein include alkali metal salts of borates and alkyl borates and mixtures thereof. Suitable borate pH buffers to be used herein are alkali metal salts of borate, metaborate, tetraborate, octoborate, pentaborate, dodecaboron, borontrifluoride and/or alkyl borate containing from 1 to 12 carbon atoms, and preferably from 1 to 4. Suitable alkyl borate includes methyl borate, ethyl borate and propyl borate. Particularly preferred herein are the alkali metal salts of metaborate (e.g. sodium metaborate), tetraborate (e.g., sodium tetraborate decahydrate) or mixtures thereof.

Boron salts like sodium metaborate and sodium tetraborate are commercially available from Borax and Societa Chimica Larderello under the trade name sodium metaborate® and Borax®.

Typically, the compositions according to the present invention comprise from 0.001% to 15% by weight of the total composition of a pH buffer, or mixtures thereof, preferably from 0.01% to 10%, more preferably from 0.01% to 5% and most preferably from 0.1% to 3%.

The compositions according to the present invention are aqueous. Preferably they comprise from 55% to 99% by weight of the total composition of water, preferably from 80% to 99%, and more preferably from 85% to 98%.

The aqueous compositions of the present invention have a pH above 8, preferably from 8.1 to 10, more preferably 8.2 to 9.5 and more preferably from 8.2 to 8.8. The pH of the compositions can be adjusted by using alkalinising agents.

Examples of alkalinising agents are alkali metal hydroxides, such as potassium and/or sodium hydroxide, or alkali metal oxides such as sodium and/or potassium oxide.

By "effective disinfecting performance" it is meant herein that the aqueous alkaline compositions of the present invention comprising said peroxygen bleach, said radical scavenger, said chelating agent and pH buffer, allow to significantly reduce the amount of bacteria on an infected surface. Indeed, effective disinfection is obtained on various microorganisms including Gram positive bacteria like *Staphylococcus aureus,* and Gram negative bacteria like *Pseudomonas aeruginosa,* as well as on fungi like *Candida albicans* present on infected surfaces.

The disinfecting performance of a composition may be measured by the bactericidal activity of said composition. A test method suitable to evaluate the bactericidal activity of a composition on clean surfaces is described in European Standard, prEN 1040, CEN/TC 216 N 78, dated November 1995 issued by the European committee for standardisation, Brussels. European Standard, prEN 1040, CEN/TC 216 N 78, specifies a test method and requirements for the minimum bactericidal activity of a disinfecting composition. The test is passed if the bacterical colonies forming units (cfu) are reduced from a $10^7$ cfu (initial level) to a $10^2$ cfu (final level after contact with the disinfecting product), i.e., a $10^5$ reduction of the viability is necessary. The compositions according to the present invention pass this test, even if used in highly diluted conditions.

By "effective chemical stability" it is meant herein that the aqueous alkaline compositions of the present invention comprising said peroxygen bleach, said radical scavenger, said chelating agent and pH buffer, provide improved chemical stability as compared, for example, to the same compositions without said radical scavenger.

Chemical stability of the compositions herein may be evaluated by measuring the concentration of available oxygen (often abbreviated to $AvO_2$) at given storage time after having manufactured the compositions. The concentration of available oxygen can be measured by chemical titration methods known in the art, such as the iodimetric method, thiosulphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970. By "improved greasy stain removal performance" it is meant herein that the aqueous alkaline compositions of the present invention comprising said peroxygen bleach, said radical scavenger, said chelating agent and pH buffer, provides improved greasy stain removal performance as compared for example to the same compositions, having the same pH, but being free of said pH buffer.

The greasy stain removal performance of a given composition on a soiled surface may be evaluated by the following test method. For example, typical soiled tiles to be used in this stain removal performance test may be white porcelain tiles stained with a thin layer of grease, such as dirty motor oil or hosehold oils (e.g., olive oil/rapeseed oil), and then baked in the oven for 1–2 hours to improve the adhesion of the grease to the tiles. A composition according to the present invention and a reference composition, e.g., the same composition being free of said pH buffer, are respectively applied neat on two identical portions of a soiled tile for 1 minute, then removed by means of running water and then tapped dry with a paper cloth.

The stain removal performance may be evaluated by comparing side by side the two portions of the tile treated as mentioned above. A visual grading scale may be used to assign differences in panel score units (psu), for example in a range from 0 to 4.

The aqueous compositions of the present invention may comprise as an optional ingredient an antimicrobial compound, or a mixture thereof.

Suitable antimicrobial compound for use herein include antimicrobial essential oils or actives thereof, paraben, glutaraldehyde or mixtures thereof.

Preferred antimicrobial compounds to be used herein are antimicrobial essential oils or actives thereof. Suitable antimicrobial essential oils to be used in the compositions herein are those essential oils which exhibit antimicrobial activity. By "actives of essential oils" it is meant herein any ingredient of essential oils that exhibit antimicrobial activity. It is speculated that said antimicrobial essential oils and actives thereof act as proteins denaturing agents. Also said antimicrobial oils and actives thereof are compounds of natural origin which contribute to the safety profile of the compositions of the present invention when used to disinfect any surface. A further advantage of said antimicrobial oils and actives thereof is that they impart pleasant odor to the aqueous alkaline compositions of the present invention without the need of adding a perfume. Thus, an advantage of the aqueous alkaline compositions according to the present invention is that they deliver not only excellent greasy stain removal performance and effective disinfecting performance but also good scent.

Such essential oils include, but are not limited to, those obtained from thyme, lemongrass, citrus, lemons, oranges, anise, clove, aniseed, cinnamon, geranium, roses, mint, lavender, citronella, eucalyptus, peppermint, camphor, sandalwood and cedar and mixtures thereof. Actives of essential oils to be used herein include, but are not limited to, thymol (present, for example, in thyme), eugenol (present, for example, in cinnamon and clove), menthol (present, for example, in mint), geraniol (present, for example, in geranium and rose), verbenone (present, for example, in vervain), eucalyptol and pinocarvone (present in eucalyptus), cedrol (present, for example, in cedar), anethol (present, for example, in anise), carvacrol, hinokitiol, berberine and mixtures thereof. Preferred actives of essential oils to be used herein are thymol, eugenol, verbenone, eucalyptol and/or geraniol.

Thymol may be commercially available for example from Aldrich, eugenol may be commercially available, for example, from Sigma, Systems—Bioindustries (SBI)—Manheimer Inc.

Suitable paraben to be used in the compositions herein include ethyl paraben, methyl paraben, propyl paraben or mixtures thereof.

Glutaraldehyde may be commercially available from Union Carbide or from BASF.

Typically, the compositions herein comprise up to 5% by weight of the total composition of said antimicrobial compound or mixtures thereof, preferably from 0.006% to 4%, more preferably from 0.05% to 2%.

The compositions of the present invention may further comprise any surfactant known to those skilled in the art including nonionic, anionic, cationic, amphoteric and/or zwitterionic surfactants. Said surfactants are desirable herein as they further contribute to the cleaning performance of the present compositions.

Typically, the compositions according to the present invention comprise up to 50% by weight of the total composition of a surfactant, or mixtures thereof, preferably from 0.1% to 30% and more preferably from 0.2% to 25%.

Particularly suitable anionic surfactants to be used herein include water-soluble salts or acids of the formula $ROSO_3M$ wherein R is preferably a $C_6$–$C_{24}$ hydrocarbyl, preferably an alkyl or hydroxyalkyl having a $C_8$–$C_{20}$ alkyl component, more preferably a $C_8$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Other suitable anionic surfactants to be used herein include alkyl-diphenyl-ether-sulphonates and alkylcarboxylates. Other anionic surfactants can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred anionic surfactants for use in the compositions herein are the alkyl benzene sulfonates, alkyl sulfates, alkyl alkoxylated sulfates, paraffin sulfonates and mixtures thereof.

Suitable amphoteric surfactants to be used herein include amine oxides having the following formula $R_1R_2R_3NO$ wherein each of R1, R2 and R3 is independently a saturated substituted or unsubstituted, linear or branched hyudrocarbon chain of from 1 to 30 carbon atoms. Preferred amine oxide surfactants to be used according to the present invention are amine oxides having the following formula $R_1R_2R_3NO$ wherein R1 is a hydrocarbon chain comprising from 1 to 30 carbon atoms, preferably from 6 to 20, more preferably from 8 to 16, most preferably from 8 to 10, and wherein R2 and R3 are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain.

Suitable amine oxides for use herein are for instance natural blend C8–C10 amine oxides as well as C12–C16 amine oxides commercially available from Hoechst.

Suitable zwitterionic surfactants to be used herein contain both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used. A generic formula for some zwitterionic surfactants to be used herein is $$R_1—N^+(R_2)(R_3)R_4X^-$$

wherein $R_1$ is a hydrophobic group; $R_2$ and $R_3$ are each $C_1$–$C_4$ alkyl, hydroxy alkyl or other substituted alkyl group which can also be joined to form ring structures with the N; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is preferably a carboxylate or sulfonate group. Preferred hydrophobic groups $R_1$ are alkyl groups containing from 1 to 24, preferably less than 18, more preferably less than 16 carbon atoms. The hydrophobic group can contain unsaturation and/or substituents and/or linking groups such as aryl groups, amido groups, ester groups and the like. In general, the simple alkyl groups are preferred for cost and stability reasons.

Highly preferred zwitterionic surfactants include betaine and sulphobetaine surfactants, derivatives thereof or mixtures thereof. Said betaine or sulphobetaine surfactants are preferred herein as they help disinfection by increasing the permeability of the bacterial cell wall, thus allowing other active ingredients to enter the cell.

Furthermore, due to the mild action profile of said betaine or sulphobetaine surfactants, they are particularly suitable for the cleaning of delicate surfaces, e.g., delicate laundry or surfaces in contact with food and/or babies. Betaine and sulphobetaine surfactants are also extremely mild to the skin and/or surfaces to be treated.

Suitable betaine and sulphobetaine surfactants to be used herein are the betaine/sulphobetaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred betaine and sulphobetaine surfactants herein are according to the formula

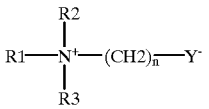

wherein R1 is a hydrocarbon chain containing from 1 to 24 carbon atoms, preferably from 8 to 18, more preferably from 12 to 14, wherein R2 and R3 are hydrocarbon chains containing from 1 to 3 carbon atoms, preferably 1 carbon atom, wherein n is an integer from 1 to 10, preferably from 1 to 6, more preferably is 1, Y is selected from the group consisting of carboxyl and sulfonyl radicals and wherein the sum of R1, R2 and R3 hydrocarbon chains is from 14 to 24 carbon atoms, or mixtures thereof.

Examples of particularly suitable betaine surfactants include C12–C18 alkyl dimethyl betaine such as coconutbetaine and C10–C16 alkyl dimethyl betaine such as laurylbetaine. Coconutbetaine is commercially available from Seppic under the trade name of Amonyl 265®. Laurylbetaine is commercially available from Albright & Wilson under the trade name Empigen BB/L®.

Other specific zwitterionic surfactants have the generic formulae:

$$R_1—C(O)—N(R_2)—(C(R_3)_2)_n—N(R_2)_2^{(+)}—(C(R_3)_2)_n—SO_3^{(-)}$$

or $$R_1—C(O)—N(R_2)—(C(R_3)_2)_n—N(R_2)_2^{(+)}—(C(R_3)_2)_n—COO^{(-)}$$

wherein each $R_1$ is a hydrocarbon, e.g. an alkyl group containing from 8 up to 20, preferably up to 18, more preferably up to 16 carbon atoms, each $R_2$ is either a hydrogen (when attached to the amido nitrogen), short chain alkyl or substituted alkyl containing from one to 4 carbon atoms, preferably groups selected from the group consisting of methyl, ethyl, propyl, hydroxy substituted ethyl or propyl and mixtures thereof, preferably methyl, each $R_3$ is selected from the group consisting of hydrogen and hydroxy groups and each n is a number from 1 to 4, preferably from 2 to 3, more preferably 3, with no more than one hydroxy group in any $(C(R_3)_2)$ moiety. The $R_1$ groups can be branched and/or unsaturated. The $R_2$ groups can also be connected to form ring structures. A surfactant of this type is a $C_{10}$–$C_{14}$ fatty acylamidopropylene(hydroxypropylene)sulfobetaine that is available from the Sherex Company under the trade name "Varion CAS sulfobetaine"®.

In a preferred embodiment of the present invention where the compositions herein are particularly suitable for the disinfection of hard-surface, the surfactant is typically a surfactant system comprising an amine oxide and a betaine or sulphobetaine surfactant, preferably in a weight ratio of amine oxide to betaine or sulphobetaine of 1:1 to 100:1, more preferably of 6:1 to 100:1 and most preferably 10:1 to 50:1. Using such a surfactant system in the hard-surface cleaning compositions herein, provides effective cleaning performance to said compositions but also provides the cleaned surfaces with a shiny effect, i.e., the amount of filming/streaking left on the cleaned surface that has been treated with said compositions is minimal.

Suitable nonionic surfactants to be used herein are fatty alcohol ethoxylates and/or propoxylates which are commercially available with a variety of fatty alcohol chain lengths and a variety of ethoxylation degrees. Indeed, the HLB values of such alkoxylated nonionic surfactants depend essentially on the chain length of the fatty alcohol, the nature of the alkoxylation and the degree of alkoxylation. Surfactant catalogues are available which list a number of surfactants, including nonionics, together with their respective HLB values.

Particularly suitable for use herein as nonionic surfactants are hydrophobic nonionic surfactants having an HLB (hydrophilic-lipophilic balance) below 16, preferably below 15, more preferably below 12, and most preferably below 10. Those hydrophobic nonionic surfactants have been found to provide good grease cutting properties.

Preferred hydrophobic nonionic surfactants to be used in the compositions according to the present invention are surfactants having an HLB below 16 and being according to the formula $RO—(C_2H_4O)_n(C_3H_6O)_mH$, wherein R is a $C_6$ to $C_{22}$ alkyl chain or a $C_6$ to $C_{28}$ alkyl benzene chain, and wherein n+m is from 0 to 20 and n is from 0 to 15 and m is from 0 to 20, preferably n+m is from 1 to 15 and, n and m are from 0.5 to 15, more preferably n+m is from 1 to 10 and, n and m are from 0 to 10. The preferred R chains for use herein are the $C_8$ to $C_{22}$ alkyl chains. Accordingly, suitable hydrophobic nonionic surfactants for use herein are Dobanol$^R$ 91-2.5 (HLB=8.1; R is a mixture of C9 and $C_{11}$ alkyl chains, n is 2.5 and m is 0), or Lutensol$^R$ TO3 (HLB=8; R is a $C_{13}$ alkyl chains, n is 3 and m is 0), or Lutensol$^R$ AO3 (HLB=8; R is a mixture of $C_{13}$ and $C_{15}$ alkyl chains, n is 3 and m is 0), or Tergitol$^R$ 25L3 (HLB=7.7; R is in the range of $C_{12}$ to $C_{15}$ alkyl chain length, n is 3 and m is 0), or Dobanol$^R$ 23-3 (HLB=8.1; R is a mixture of $C_{12}$ and $C_{13}$ alkyl chains, n is 3 and m is 0), or Dobanol$^R$ 23-2 (HLB=6.2; R is a mixture of $C_{12}$ and $C_{13}$ alkyl chains, n is 2 and m is 0), or Dobanol$^R$ 45-7 (HLB=11.6; R is a mixture of $C_{14}$ and $C_{15}$ alkyl chains, n is 7 and m is 0) Dobanol$^R$ 23-6.5 (HLB=11.9; R is a mixture of $C_{12}$ and $C_{13}$ alkyl chains, n is 6.5 and m is 0), or Dobanol$^R$ 25-7 (HLB=12; R is a mixture of $C_{12}$ and $C_{15}$ alkyl chains, n is 7 and m is 0), or Dobanol$^R$ 91-5 (HLB=11.6; R is a mixture of $C_9$ and $C_{11}$ alkyl chains, n is 5 and m is 0), or Dobanol$^R$ 91-6 (HLB=12.5; R is a mixture of $C_9$ and $C_{11}$ alkyl chains, n is 6 and m is 0), or Dobanol$^R$ 91-8 (HLB=13.7; R is a mixture of $C_9$ and $C_{11}$ alkyl chains, n is 8 and m is 0), Dobanol$^R$ 91-10 (HLB=14.2; R is a mixture of $C_9$ to $C_{11}$ alkyl chains, n is 10 and m is 0), or mixtures thereof. Preferred herein are Dobanol$^R$ 91-2.5 , or Lutensol$^R$ TO3, or Lutensol$^R$ AO3, or Tergitol$^R$ 25L3, or Dobanol$^R$ 23-3, or Dobanol$^R$ 23-2, or Dobanol$^R$ 23-10, or mixtures thereof. These Dobanol$^R$ surfactants are commercially available from SHELL. These Lutensol$^R$ surfactants are commercially available from BASF and these Tergitol$^R$ surfactants are commercially available from UNION CARBIDE.

The aqueous composition herein may comprise as an optional ingredient a solvent or a mixture thereof. When used, solvents will advantageously give an enhanced cleaning to the compositions herein. Suitable solvents for incorporation in the compositions according to the present invention include propylene glycol derivatives such as n-butoxypropanol or n-butoxypropoxypropanol, water-soluble CARBITOL® solvents or water-soluble CELLOSOLVE® solvents. Water-soluble CARBITOL® solvents are compounds of the 2-(2-alkoxyethoxy)ethanol class wherein the alkoxy group is derived from ethyl, propyl or butyl. A preferred water-soluble carbitol is 2-(2-butoxyethoxy)ethanol also known as butyl carbitol. Water-soluble CELLOSOLVE® solvents are compounds of the 2-alkoxyethoxyethanol class, with 2-butoxyethoxyethanol being preferred. Other suitable solvents are benzyl alcohol, methanol, ethanol, isopropyl alcohol and diols such as 2-ethyl-1,3-hexanediol and 2,2,4-trimethyl-1,3-pentanediol and mixture thereof. Preferred solvents for use herein are n-butoxypropoxypropanol, butyl carbitol® and mixtures thereof. A most preferred solvent for use herein is butyl carbitol®.

The solvents may typically be present within the compositions of the present invention at a level up to 10% by weight, preferably from 0.1% to 8% and more preferably from 0.5% to 6% by weight of the total composition.

The compositions according to the present invention may comprise as an optional ingredient, a shear thinning polymeric thickener or a mixture thereof.

Such shear thinning polymeric thickeners are suitable herein as they perform a dual function when they are incorporated in the liquid composition according to the present invention, said function being not only to prevent or diminish inhalation by the user of peroxygen bleach mist/fog when the composition of the present invention is sprayed onto the surface to be disinfected, but also to provide increased contact time of the composition on vertical surfaces, thereby reducing the risk of composition dripping.

Suitable shear thinning polymeric thickeners to be used herein include synthetic and natural occurring polymers. Suitable shear thinning polymeric thickeners for used herein include polyurethane polymers, polyacrylamide polymers, polycarboxylate polymers such as polyacrylic acids and sodium salts thereof, xanthan gum or derivatives thereof, alginate or a derivative thereof, polysaccharide polymers such as substituted cellulose materials like ethoxylated cellulose, carboxymethylcellulose, hydroxymethylcellulose, hydroxypropyl cellulose, hydroxyethyl cellulose and mixtures thereof.

Preferred shear thinning polymeric thickeners for use in the compositions of the invention are xanthan gum or derivatives thereof sold by the Kelco Division of Merck under the tradenames KELTROL®, KELZAN AR®, KELZAN D35®, KELZAN S®, KELZAN XZ® and the like.

Xanthan gum is an extra cellular polysaccharide of xanthomonas campestras. Xanthan gum is made by fermentation based on corn sugar or other corn sweetener by-products. Xanthan gum comprises a poly beta-(1→4)-D-Glucopyranosyl backbone chain, similar to that found in cellulose. Aqueous dispersions of xanthan gum and its derivatives exhibit remarkable rheological properties. Xanthan gum exhibits high pseudoplasticity, i.e., over a wide range of concentrations, rapid shear thinning occurs that is generally understood to be instantaneously reversible. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which patent is incorporated by reference herein. Suitable crosslinking agents for xanthan materials include metal cations such as Al+3, Fe+3, Sb+3, Zr+4 and other transition metals, etc. Known organic crosslinking agents can also be used. The preferred crosslinked xanthan agent of the invention is KELZAN AR®, a product of Kelco, a division of Merck Incorporated.

The polycarboxylate polymers for use herein preferably have a molecular weight of from 500.000 to 4.500.000, preferably from 1.000.000 to 4.000.000. Most preferred polymers for use herein contain from 0.5% to 4% by weight of a cross-linking agent, wherein the cross-linking agent tends to interconnect linear strands of the polymers to form the resulting cross-linked products. Suitable cross-linking agents include the polyalkenyl polyethers. Polycarboxylate polymers include the polyacrylate polymers. Others monomers besides acrylic acid can be used to form these polymers including such monomers as maleic anhydride which acts as a source of additional carboxylic groups. The molecular weight per carboxylate group of monomers containing a carboxylate group typically varies from 25 to 200, preferably from 50 to 150, more preferably from 75 to 125. Further other monomers may be present in the monomeric mixture, if desired, such as ethylene and propylene which act as diluents.

Preferred polycarboxylate polymers for use herein are the polyacrylate polymers. Commercially available polymers of the polyacrylate type include those sold under the trade names Carbopol®, Acrysol® ICS-1, Polygel®, and Sokalan®. Most preferred polyacrylate polymers are the copolymer of acrylic acid and alkyl ($C_5$–$C_{10}$) acrylate, commercially available under the tradename Carbopol® 1623, Carbopol® 695 from BF Goodrich, and copolymer of acrylic acid and maleic anhydride, commercially available under the tradename Polygel® DB from 3V Chemical company. Mixtures of any of the polycarboxylate polymers, hereinbefore described, may also be used.

The compositions according to the present invention may comprise up to 10% by weight of the total composition of a shear thinning polymeric thickener, or mixtures thereof, preferably from 0.02% to 5% by weight, more preferably from 0.02% to 2% and most preferably from 0.02% to 1%.

The aqueous compositions herein may further comprise a variety of other optional ingredients such as builders, stabilisers, bleach activators, soil suspenders, dye transfer agents, brighteners, anti dusting agents, enzymes, dispersant, dye transfert inhibitors, pigments, perfumes, and dyes.

The aqueous compositions according to the present invention formulated in a liquid form may be applied neat or diluted. Accordingly, the present invention encompasses a process of cleaning a surface wherein a composition as described hereinbefore, is applied onto said surface.

By "surface" it is meant herein any surface including animate surface like human skin, mouth, teeth and inanimate surfaces. Inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on. The compositions of the present invention have been found to be particularly suitable for the cleaning and/or disinfection of non-horizontal hard surfaces.

Preferably the compositions according to the present invention are applied to the surface to be cleaned in their diluted form.

By "diluted form" is meant herein that the compositions according to the present invention which are in a liquid form or in a solid form may be diluted with a liquid, typically water by the user. Said compositions may be diluted by the user typically up to 100 times their weight of water, preferably into 80 to 40 times their weight of water and more preferably 60 to 30.

Accordingly, the present invention also encompasses diluted compositions obtainable by diluting in water a composition according to the present invention.

The aqueous compositions herein may be packaged in a variety of suitable detergent packaging known to those skilled in the art. The aqueous compositions herein may desirably be packaged in manually operated spray dispensing containers, which are usually made of synthetic organic polymeric plastic materials. Accordingly, the present invention also encompasses aqueous cleaning compositions as described hereinbefore packaged in a spray dispenser, preferably in a trigger spray dispenser or in a pump spray dispenser.

For example, said spray-type dispensers allow to uniformly apply to a relatively large area of a surface to be cleaned, the aqueous compositions of the present invention, thereby contributing to cleaning properties of said compositions. Such spray-type dispensers are particularly suitable to treat vertical surfaces.

Suitable spray-type dispensers to be used according to the present invention include manually operated foam trigger-type dispensers sold, for example, by Specialty Packaging Products, Inc. or Continental Sprayers, Inc. These types of dispensers are disclosed, for instance, in U.S. Pat. No. 4,701,311 to Dunnining et al. and U.S. Pat. Nos. 4,646,973 and 4,538,745 both to Focarracci. Particularly preferred to be used herein are spray-type dispensers such as T 8500® or T8900® commercially available from Continental Sprayers International or T 8100® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e., to help the formation of liquid droplets.

The compositions of the present invention may also be executed in the form of wipes. By "wipes" it is meant herein disposable towels impregnated with a liquid composition according to the present invention. Preferably, said wipes are packaged in a plastic box. Accordingly, the present invention also encompasses wipes, e.g., disposable paper towels, impregnated/wetted with a liquid composition as described hereinbefore. The advantage of this execution is a faster usage of a cleaning composition by the user, this even outside the house, i.e. there is no need to pour the liquid compositions according to the present invention on the surfaces to be cleaned and to dry it out with a cloth. In other words, wipes allow cleaning of surfaces in one step.

The present invention will be further illustrated by the following examples.

EXAMPLES

The following compositions were made by mixing the listed ingredients in the listed proportions (weight % unless otherwise specified).

| Compositions (weight %) | I | II | III | IV | V | VI |
|---|---|---|---|---|---|---|
| Hydrogen peroxide | 2.0 | 1.0 | 1.0 | 1.0 | 2.5 | 3.0 |
| Betaine* | 2.0 | 1.0 | 0.5 | 0.5 | 0.3 | 3.0 |
| Lauryl amine oxide | 1.5 | 1.5 | 2.0 | 2.0 | 1.0 | 1.0 |
| Thymol | 0.05 | 0.1 | — | — | — | — |
| Geraniol | — | — | 0.05 | 0.1 | — | — |
| Eucalyptol | 0.1 | — | 0.05 | — | — | — |
| Ethyl paraben | — | — | — | — | 0.4 | 0.4 |
| Eugenol | — | — | — | — | — | 0.2 |
| HEDP | 0.1 | — | 0.1 | 0.05 | 0.2 | 0.3 |
| ATMP | — | 0.1 | — | — | — | — |
| BHT | 0.05 | 0.05 | 0.1 | 0.1 | 0.1 | 0.15 |
| Tetraborate | 0.5 | 0.5 | 0.5 | 1.0 | 1.0 | 1.5 |
| Water and minors | | | up to 100% | | | |
| NaOH up to pH 8.5 | | | | | | |

Betaine* is either coconut betaine commercially available from Seppic under the trade name Amonyl 265 ® or laurylbetaine commercially available from Albright & Wilson under the trade name Empigen BB/L ® or mixtures thereof.
HEDP is etidronic acid.
ATMP is nitrilotris(methylene)triphosphonic acid.
BHT is tert-butyl hydroxy toluene.
Tetraborate is sodium tetraborate decahydrate.

| Compositions (weight %) | VII | VIII | IX | X | XI | XII |
|---|---|---|---|---|---|---|
| Hydrogen peroxide | 2.0 | 2.0 | 3.0 | 1.0 | 1.0 | 1.0 |
| Betaine* | 1.5 | 1.0 | 1.0 | 1.0 | 0.1 | 0.1 |
| Lauryl amine oxide | 1.0 | 1.0 | 3.0 | 3.0 | 3.0 | 2.0 |
| Thymol | — | 0.1 | — | — | — | — |
| Geraniol | — | — | 0.05 | 0.1 | — | — |
| Eucalyptol | — | — | 0.05 | — | — | — |
| Ethyl paraben | — | — | — | — | 0.4 | 0.4 |
| Eugenol | — | — | — | — | — | 0.2 |
| Dobanol 91-10 ® | 0.5 | 0.5 | 0.3 | 0.3 | 0.1 | 0.1 |
| HEDP | 0.1 | — | 0.1 | 0.05 | 0.2 | 0.3 |
| ATMP | — | 0.1 | — | — | — | — |
| BHT | — | — | — | — | — | 0.08 |
| BHA | 0.1 | 0.1 | 0.05 | 0.05 | 0.08 | — |
| Borate | — | — | 0.7 | 0.7 | 1.0 | 1.0 |
| Tetraborate | 0.5 | 0.5 | — | — | — | — |
| Water and minors | | | up to 100% | | | |
| NaOH up to pH 8.5 | | | | | | |

BHA is butylhydroxyanisol.

These aqueous compositions passed the prEN 1040 test of the European committee of standardisation. These compositions provide excellent disinfection when used neat or diluted, e.g. at 1:100, 1:25, 1:50 dilution levels, and excellent greasy stain removal performance.

Also these compositions have excellent chemical stability upon prolonged storage periods and/or in stressed conditions, i.e., they did not undergone more than 7% available oxygen loss after 10 days at 50° C.

What is claimed is:

1. A stable liquid aqueous cleaning composition having a pH above 8 comprising:

a) from 0.1% to 30% by weight, of a zwitterionic surfactant having the formula:

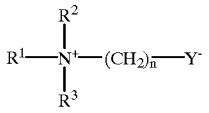

wherein $R^1$ is a $C_1$–$C_{24}$ hydrocarbon chain, $R^2$ and $R^3$ are each a $C_1$–$C_3$ hydrocarbon chain; Y is selected from the group consisting of carboxyl, sulfonyl, and mixtures thereof; n is from 1 to 10; and the sum of the number of carbon atoms which comprise $R^1$, $R^2$, and $R^3$ is from 14 to 24;

b) from 0.01% to 15% by weight of a peroxygen bleach;

c) from 0.001% to 10% by weight, of a chelating agent selected from the group consisting of phosphonates, aminophosphonates, substituted heteroaromatic compounds, and mixtures thereof;

d) from 0.0005% to 5% by weight, of a free radical scavenger selected from the group consisting of di-tert-butyl hydroxy toluene, p-hydroxytoluene, hydroquinone, di-tert-butylhydroquinone, mono-tert-butylhydroquinone, tert-butylhydroxyanisole, p-hydroxyanisole, benzoic acid, 2,5-dihydroxy benzoic acid, 2,5-dihydroxyterephthalic acid, toluic acid, catechol, t-butyl catechol, 4-allylcatechol, 4-acetylcatechol, 2-methoxyphenol, 2-ethoxyphenol, 2-methoxy-4(2-propenyl)phenol, 3,4-dihydroxybenzaldehyde, 2,3-dihydroxybenzyaldehyde, benzylamine, 1,1,3-tris(2-methyl-4-hydroxy-5-t-butylphenyl)butane, tert-butylhydroxyaniline, p-hydroxyaniline, n-propyl gallate, or mixtures thereof;

e) from 0.006% to 4% by weight, of an antimicrobial essential oil selected from the group consisting of thymol, eugenol, menthol, carvacrol, verbenone, eucalyptol, cedrol, anethol, pinocarvone, geraniol, hinokitiol, berberine, and mixtures thereof;

f) from 0.1% to 8% by weight, of a solvent selected from the group consisting of 2-(2-butoxyethoxy)ethanol, 2-butoxyethoxyethanol, benzyl alcohol, n-butoxypropoxypropanol, and mixtures thereof; and g) from 0.001% to 15% by weight, of a pH buffer selected from the group consisting of an alkali metal salt of borate, metaborate, tetraborate, octoborate, pentaborate, dodecaborate, borontrifluoride, an alkyl borate containing from 1 to 12 carbon atoms, and mixtures thereof.

2. A composition according to claim 1 comprising from 0.2% to 25% by weight, of said surfactant.

3. A composition according to claim 1 comprising from 0.1% to 10% by weight, of said peroxygen bleach.

4. A composition according to claim 3 comprising from 0.5% to 8% by weight, of said peroxygen bleach.

5. A composition according to claim 4 comprising from 0.3% to 5% by weight, of said peroxygen bleach.

6. A composition according to claim 1 wherein said peroxygen bleach is hydrogen peroxide or a source of hydrogen peroxide selected from the group consisting of percarbonate, persilicate, persulphate, perborate, peroxyacids, dialkyl peroxides, diacyl peroxides, preformed percarboxylic acids, organic peroxides, inorganic peroxides, hydroperoxides, and mixtures thereof.

7. A composition according to claim 1 comprising from 0.005% to 5% by weight, of said chelating agent.

8. A composition according to claim 7 comprising from 0.01% to 2% by weight, of said chelating agent.

9. A composition according to claim 1 wherein said chelating agent is 1-hydroxyethylene diphosphonic acid, in alkali metal ethane 1-hydroxy diphosphonate, nitrilo tris (methylene)triphosphonate, ethylenediamine tetramethylene phosphonate, diethylene triamine pentamethylene phosphonate, 2-hydroxypyridine-N-oxide, or mixtures thereof.

10. A composition according to claim 1 comprising from 0.005% to 1.5% by weight, of said free radical scavenger.

11. A composition according to claim 10 comprising from 0.01% to 1% by weight, of said free radical scavenger.

12. A composition according to claim 1 comprising from 0.05% to 2% by weight, of said essential oil.

13. A composition according to claim 1 comprising from 0.5% to 6% by weight, of a solvent.

14. A composition according to claim 1 comprising from 0.01% to 10% by weight, of said pH buffer.

15. A composition according to claim 14 comprising from 0.01% to 5% by weight, of said pH buffer.

16. A composition according to claim 15 comprising from 0.1% to 3% by weight, of said pH buffer.

17. A composition according to claim 1 wherein said pH buffer is an alkali metal salt of metaborate, tetraborate, or mixtures thereof.

18. A composition according to claim 1 wherein said composition has a pH of from 8.1 to 10.

19. A composition according to claim 18 wherein said composition has a pH of from 8.2 to 9.5.

20. A composition according to claim 19 wherein said composition has a pH of from 8.2 to 8.8.

* * * * *